US011371178B2

(12) United States Patent
Marks et al.

(10) Patent No.: US 11,371,178 B2
(45) **Date of Patent: *Jun. 28, 2022**

(54) PORTABLE PARTS WASHER

(71) Applicant: CRC Industries, Inc., Warminster, PA (US)

(72) Inventors: Francis A. Marks, Sandy Springs, GA (US); Walter F. Ottmann, Duluth, GA (US); Thomas W. McNally, Norcross, GA (US)

(73) Assignee: CRC Industries, Inc., Warminster, PA (US)

( * ) Notice: Subject to any disclaimer, the term of this patent is extended or adjusted under 35 U.S.C. 154(b) by 247 days.

This patent is subject to a terminal disclaimer.

(21) Appl. No.: 16/821,662

(22) Filed: Mar. 17, 2020

(65) Prior Publication Data

US 2020/0215585 A1 Jul. 9, 2020

Related U.S. Application Data

(60) Division of application No. 15/716,191, filed on Sep. 26, 2017, now Pat. No. 10,618,081, which is a (Continued)

(51) Int. Cl.
*D06F 39/08* (2006.01)
*B08B 3/00* (2006.01)
(Continued)

(52) U.S. Cl.
CPC ..... *D06F 39/083* (2013.01); *B08B 3/006* (2013.01); *B08B 3/045* (2013.01); *B08B 3/06* (2013.01);
(Continued)

(58) Field of Classification Search
None
See application file for complete search history.

(56) References Cited

U.S. PATENT DOCUMENTS 3,343,555 A 9/1967 Kasner
3,416,544 A 12/1968 Paiva
(Continued)

OTHER PUBLICATIONS

ATD-8524 3.5 Gallon Bench Top Parts Washer brochure—ATD Tools, Inc.—http://atdtools.com/8524, prior to Oct. 26, 2012.
(Continued)

*Primary Examiner* — Rita P Adhlakha
(74) *Attorney, Agent, or Firm* — Flaster Greenberg PC

(57) ABSTRACT

A portable parts washer for cleaning mechanical parts that includes a washer body having an upper portion, a lower portion, and a wash basin formed within the upper portion having inner sidewalls, a floor panel and at least one drain aperture. The portable parts washer also includes an in-use reservoir formed within the lower portion of the washer body and having a bottom panel spaced from the floor panel and outer sidewalls, and which is configured to receive cleaning fluid from the wash basin through the drain aperture when the floor panel is in a substantially horizontal orientation. The portable parts washer further includes a storage reservoir formed within the upper and lower portions and which is configured to contain the cleaning fluid from the in-use reservoir when the floor panel is rotated to a substantially vertical orientation.

15 Claims, 5 Drawing Sheets

Related U.S. Application Data continuation of application No. 14/824,293, filed on Aug. 12, 2015, now Pat. No. 9,802,228, which is a continuation of application No. 14/031,173, filed on Sep. 19, 2013, now Pat. No. 9,132,455.

(60) Provisional application No. 61/719,705, filed on Oct. 29, 2012.

(51) Int. Cl.

| | |
|---|---|
| ***D06F 39/12*** | (2006.01) |
| ***D06F 1/00*** | (2006.01) |
| ***D06F 3/02*** | (2006.01) |
| ***D06F 17/04*** | (2006.01) |
| ***B08B 3/04*** | (2006.01) |
| ***B08B 3/06*** | (2006.01) |

(52) U.S. Cl.

CPC ..... *D06F 1/00* (2013.01); *D06F 3/02* (2013.01); *D06F 17/04* (2013.01); *D06F 39/12* (2013.01)

(56) References Cited

U.S. PATENT DOCUMENTS

| | | | |
|---|---|---|---|
| 4,051,858 | A | 10/1977 | Mele |
| 4,056,114 | A | 11/1977 | Boutillette |
| 4,226,548 | A | 10/1980 | Reith |
| 4,462,415 | A | 7/1984 | Otzen |
| 4,601,300 | A | 7/1986 | Sundheimer |
| 4,817,649 | A | 4/1989 | Schmalz et al. |
| 5,213,119 | A | 5/1993 | Kusz et al. |
| 5,220,933 | A | 6/1993 | Albers |
| 5,419,349 | A | 5/1995 | Sawain |
| 5,622,196 | A | 4/1997 | Luongo |
| 5,640,981 | A | 6/1997 | Neimela et al. |
| 5,961,733 | A | 10/1999 | Strange |
| 6,019,110 | A | 2/2000 | McClure et al. |
| 6,044,854 | A | 4/2000 | Marks et al. |
| 6,074,491 | A | 6/2000 | McClure et al. |
| 6,095,163 | A | 8/2000 | McClure et al. |
| 6,279,587 | B1 | 8/2001 | Yamamoto |
| 6,318,387 | B1 | 11/2001 | McClure et al. |
| 6,328,045 | B1 | 12/2001 | Strange |
| 6,374,835 | B1 | 4/2002 | McClure et al. |
| 6,440,226 | B2 | 8/2002 | McClure et al. |
| 6,451,125 | B1 | 9/2002 | McClure et al. |
| 6,463,756 | B1 | 10/2002 | Lewis |
| 6,523,556 | B2 | 2/2003 | Abad et al. |
| 6,571,810 | B1 | 6/2003 | McClure et al. |
| 2010/0162479 | A1 | 7/2010 | Tai |

OTHER PUBLICATIONS

Baron Portable Parts Washer brochure—Parts Unlimited Street—http://www.motorcycleworld.com/enthusiasts/catalog_itemdetal.asp?catalog=8024&lev . . . , prior to Oct. 26, 2012.

Black Bull Parts Washer brochure—http://www.sears.com/black-bull-pwash35-parts-washer-with-3.5-gallon-capacity/p-SPM . . . , prior to Oct. 26, 2012.

JobSmart Portable Pads Washer, 20 gallon borchure—Tractor Supply Company—http://www.tractorsupply.com/parts-washer-accessories/jobsmart-reg-portable-parts-was . . . , prior to Oct. 26, 2012.

Wash 'N Go Compact Sink/Organizer (00983403) brochure—Relance Products—http://www.relianceproducts.com/products/sanitation/91.html, prior to Oct. 26, 2012.

Safety-Kleen Benchtop Parts Washer (Model 14) brochure—http://s-kstore.com/index.php/benchtop-parts-washer-model-14.html?SID=5f578bec8454 . . . , prior to Oct. 26, 2012.

Speedway 3.5 Gallon Portable Parts Washer brochure—North American Tool Industries—http://northamericantoolindustries.com/speedway-3-5-gallon-portable-parts-washer.html, prior to Oct. 26, 2012.

Wel-Bilt 3½ Gallon Portable Parts Washer brochure—Northern Tool—http://www.northerntool.com/shop/tools/product_200381752_200381752, prior to Oct. 26, 2012.

PORTABLE PARTS WASHER

CROSS-REFERENCE TO RELATED APPLICATIONS

This patent application is a division of U.S. patent application Ser. No. 15/716,191, filed Sep. 26, 2017, which is a continuation of U.S. patent application Ser. No. 14/824,293, filed Aug. 12, 2015; now U.S. Pat. No. 9,802,228, which is a continuation of U.S. patent application Ser. No. 14/031,173, filed Sep. 19, 2013; now U.S. Pat. No. 9,132,455, which application claims the benefit of U.S. provisional patent application Ser. No. 61/719,705, filed on Oct. 29, 2012. The entire disclosures of these applications are incorporated herein by reference as if set forth in their entireties.

FIELD OF THE INVENTION

The present invention relates generally to parts washers for cleaning and degreasing mechanical parts and equipment, and in particular to portable parts washers which can be moved between locations without first emptying the cleaning fluid.

BACKGROUND

With the development of increased awareness and concerns for the adverse impacts created by the disposal of large amounts of potentially hazardous liquids, including cleaning fluids which have been used to clean and degrease mechanical parts and equipment, a need has developed to remediate cleaning fluids in-situ and to reduce the amount of used cleaning fluids creating during normal industrial processes which require disposal.

BRIEF DESCRIPTION OF THE DRAWINGS

These and various other advantages, features, and aspects of the present invention will become apparent and more readily appreciated from the following detailed description of the embodiments taken in conjunction with the accompanying drawings, as follows.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

The following description is provided as an enabling teaching of exemplary embodiments of a portable parts washer for cleaning and/or degreasing mechanical parts and components. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. In other words, features from one embodiment or aspect may be combined with features from any other embodiment or aspect in any appropriate combination. In addition, any individual or collective features of method aspects or embodiments may be applied to apparatus, product or component aspects or embodiments and vice versa. Accordingly, those who work in the art will recognize that many modifications and adaptations to the disclosed embodiments are possible and may even be desirable in certain circumstances, and are a part of the invention. Thus, the following description is provided as an illustration of the principles of the embodiments and not in limitation thereof, since the scope of the invention is to be defined by the claims.

As described in more detail below, moreover, the portable parts washer of the present disclosure may also provide several significant advantages and benefits over other devices and methods for cleaning and/or degreasing mechanical parts and components. The recited advantages are not meant to be limiting in any way, however, as one skilled in the art will appreciate that other advantages may also be realized upon practicing the present invention.

Figure 1:
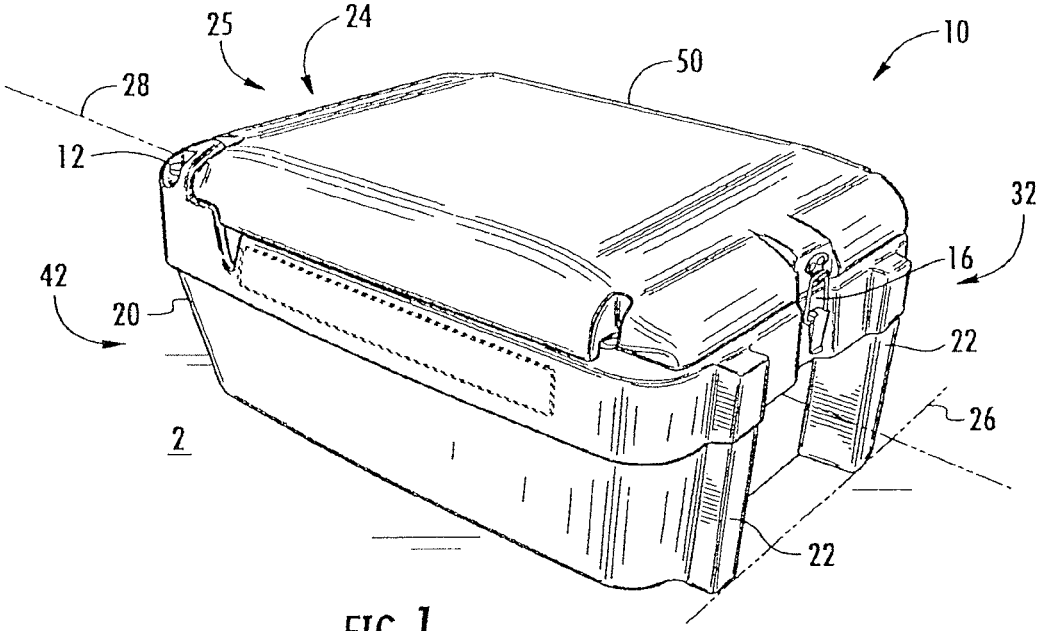
FIG. 1 is a perspective view of a portable parts washer in a closed configuration and horizontal orientation, in accordance with a representative embodiment of the disclosure.
Figure 2:
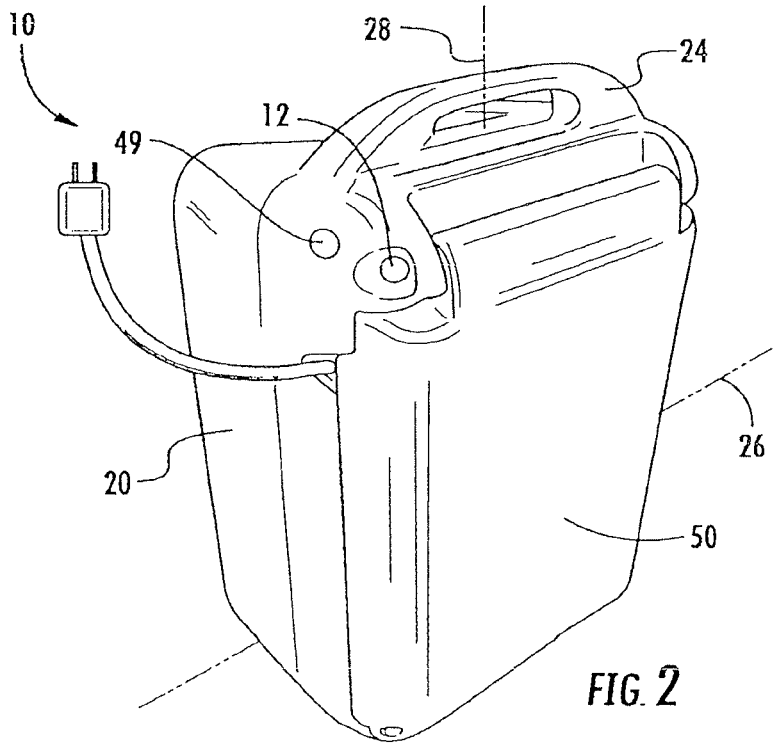
FIG. 2 is a perspective view of the closed portable parts washer of FIG. 1 in a vertical, upright and transportable orientation.

Illustrated in FIGS. 1-8 is one representative embodiment of a portable parts washer 10 for cleaning and/or degreasing mechanical parts and components. As shown in a horizontal orientation in FIGS. 1, 3 and 4 and in a vertical orientation in FIG. 2, parts washer 10 includes a washer body 20 having an upper portion 32 and a lower portion 42, and with a lid 50 rotatably attached to the washer body 20 with a hinge 12 at one end of the upper portion 32. The lid 50 may also be secured to the washer body 20 at the opposite end of the upper portion with a latch 16. The washer body 20 and lid 50 are shown in a closed configuration in FIGS. 1-2, so that the lid 50 covers the top opening of a wash basin 30 (FIGS. 3-4) formed into the upper portion 32 of the washer body 20. In FIG. 1, the lower portion 42 of the washer body 20 is supported on a base surface 2 by one or more support pads 27 (FIGS. 6 and 7) which can project outwardly from the bottom panel 46 which forms the support base of the washer body 20 when it is positioned in a horizontal orientation.

The portable parts washer 10 also includes a pair of feet 22 extending outwardly from a back end 23 of the washer body 20 and a handle 24 extending outwardly from a front end 25. The washer body 20 can further include a pivot axis 26 located proximate the lower end of the feet 22, as well as a lifting axis 28 extending through the center of the washer body from between the feet 22 toward the handle 24. When the portable parts washer 10 is rotated about the pivot axis 26 from the horizontal orientation of FIG. 1 to the vertical and upright orientation of FIG. 2, the parts washer becomes stably supported on the base surface 2 by the pair of feet 22, which can extend across the back end 23 of the washer body 20 from the lower portion 42 to the upper portion 32. As can be seen, the lifting axis 28 is also rotated to the vertical orientation in FIG. 2, so that the portable parts washer 10 can be lifted upward and carried about using the handle 24.

Figure 3:
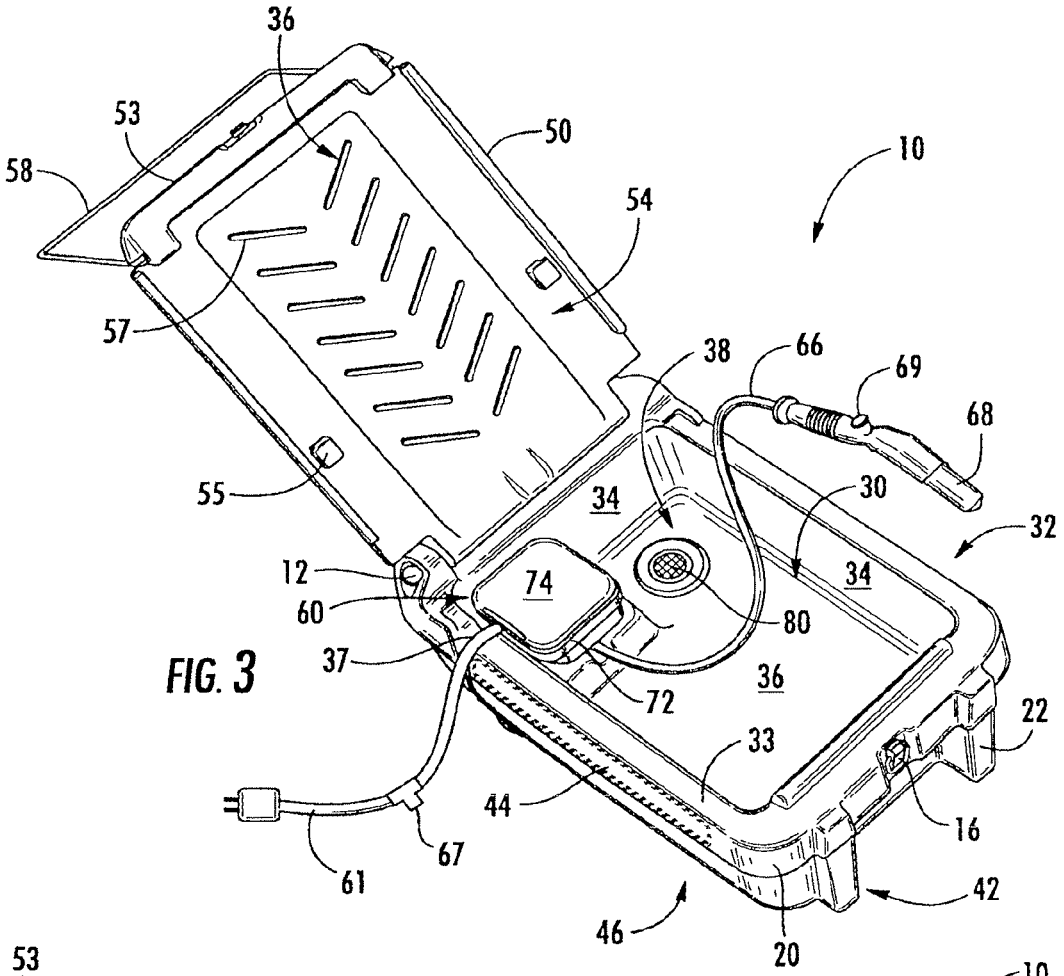
FIG. 3 is a perspective top view of the portable parts washer of FIG. 1 in an open and horizontal, in-use configuration.
Figure 4:
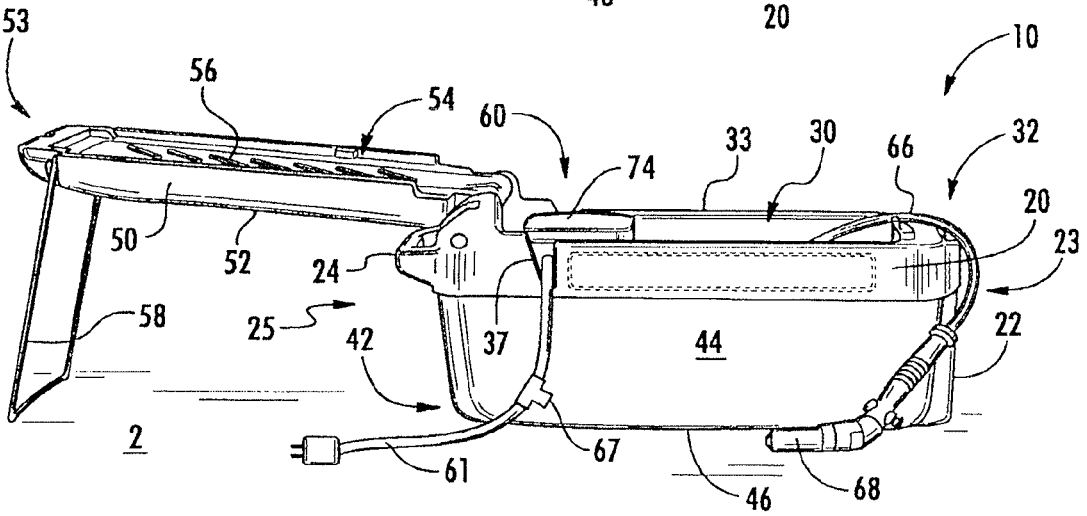
FIG. 4 is a perspective side view of the portable parts washer of FIG. 1 in the open and horizontal, in-use configuration.

The parts washer 10 is shown in FIGS. 3-4 in the open and horizontal, in-use configuration, which reveals the wash basin 30 formed into the upper portion 32 of the wash body. The wash basin 30 includes a plurality of inner sidewalls 34 which extend downward to curve into a floor panel 36 that forms the bottom surface of the wash basin 30. The wash basin further includes one or more drain apertures 38 which allow any fluid contained within the wash basin to drain into the internal reservoir (see FIGS. 6-8) located, at least in part, within the lower portion 42 of the washer body 20. As illustrated, the drain aperture 38 may be located in the floor panel 36 of the wash basin 30, which floor panel 36 can be substantially horizontal or contoured so that the drain aperture 38 is located in the lowest portion of the floor panel 36. However, it is also contemplated that the floor panel 36 can be provided with a sloped top surface so that the one or more drain apertures 38 may also be formed into the lower portions of the inner sidewalls 34 and still provide natural drainage to the internal reservoir below. Generally, the floor panel 36 can be substantially parallel with the lifting axis 28 of the washer body 20 shown in FIG. 1, so that when the lifting axis 28 is substantially horizontal the floor panel 36 is also substantially horizontal, and when the lifting axis 28 is substantially vertical (FIG. 2) the floor panel 36 is also substantially vertical.

Also shown in FIGS. 3-4 are the outer sidewalls 44 of the washer body 20 that extend from the top edges 33 of the upper portion 32 to the bottom panel 46 in the lower portion 42. As will be discussed in more detail below, the outer sidewalls 44 can be spaced outwardly from the inner sidewalls 34 of the wash basin 30 to form a perimeter gap portion within the internal reservoir which surrounds the sides of the wash basin 30.

As disclosed above, in the illustrated embodiment the lid 50 can be rotatably coupled to the washer body 20 with a hinge 12 at one end of the upper portion 32, such as proximate the front end 25 and the handle 24 of the washer body 20. In this configuration, the lid 50 is rotatably attached to the washer body 20 and will naturally tend to close or remain closed when the parts washer 10 is rotated to the vertical and upright position shown in FIG. 2, even if the latch 16 at the back end 23 is not engaged. This can be advantageous for keeping the washer body 20 and lid 50 together, and for preventing the lid 50 from inadvertently falling open if the hinge 12 were located proximate the back end 23. Nevertheless, it is contemplated that other configurations for attaching the lid 50 to the washer body 20 are also possible and considered to fall within the scope of the present disclosure. For instance, the lid 50 may also be entirely separable form the washer body 20, and attachable with latches 16 installed at both the back end 23 and front end 25 of the washer body. In other aspects, moreover, the lid 50 may also be rotatably attached to the washer body proximate the top edge 33 of one of the lateral side panels of the washer body 20.

When positioned in the open and in-use position, as shown in FIG. 4, the lid 50 can be supported over the same base surface 2 as the washer body 20 with a support bracket 58 that extends downwardly from the lid 50. In the illustrated embodiment, the support bracket 58 can be rotated around the free end 53 of the lid 50 when not in use, to be captured by tabs 55 projecting from the inside surface 54 of the lid, such as those as shown in FIG. 3. Alternatively, one or more exterior support brackets (not shown) can be pinned and pivotably captured within the outside surface 52 of the lid 50, or can be extended in telescoping fashion to contact the base surface 2.

Also shown in FIGS. 3 and 4, the inside surface 54 of the lid 50 can form a drying surface for the mechanical parts which have just been washed within the wash basin 30. In one aspect, the lid 50 can be provided with a slope sufficient to direct any excess cleaning fluid dripping from the washed components to flow back into the wash basin 30. Moreover, the inside surface 54 can include protrusions 56, such as ribs 57, which can elevate the drying parts above the inside surface 54 to improve drying airflow and can direct or channel the cleaning solution toward the center portion of the inside surface 54, and from thence back into the wash basin 30.

In the illustrated embodiment, the parts washer 10 further comprises a recirculating parts washer system that includes a pumping unit 60 which withdraws cleaning fluid from the internal reservoir to spray onto the mechanical parts and components in the wash basin 30 which are to be cleaned. Visible in FIGS. 3 and 4 are the cover 74 of a pump housing 72 as well as a housing fixture 35 formed in the wash basin 30 which is configured to receive and support the pump housing 72. Also visible is a power cord 61 which electrically connects the pumping unit 60 with an electrical power supply, and which feeds through a notch 37 formed into one of the top edges 33 of the upper portion 32. In one aspect the power cord 61 can include a power switch 67 which connects or disconnects the pumping unit from the electrical power supply. The pumping unit 60 also includes a flexible hose 66 and nozzle 68 which receive the pressurized cleaning fluid flowing from the outlet of the pump, as well as a valve/pump control switch 69 which can release/cause the cleaning fluid to be discharged from the nozzle 68.

Figure 5:
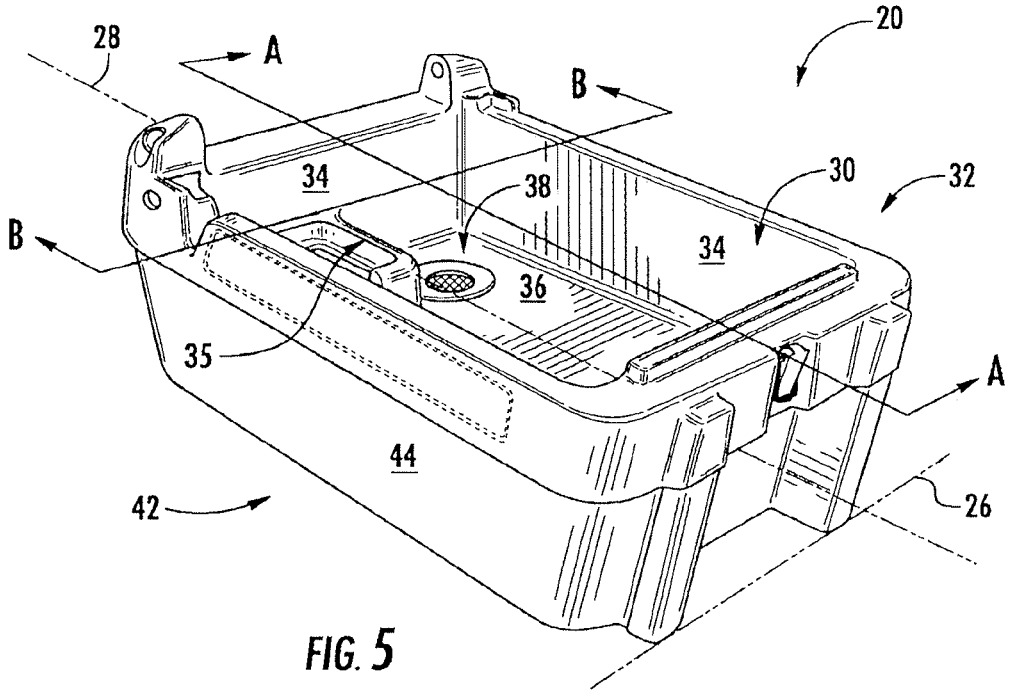
FIG. 5 is a perspective view of the washer body of the portable parts washer of FIG. 1.

FIG. 5 is a perspective side view of the washer body 20 of the portable parts washer 10 of FIG. 1-4 showing Section Line A-A, which can be parallel with the lifting axis 28 of FIG. 1, and Section Line B-B, which is perpendicular to Section Line A-A and which cuts through both the drain aperture 38 and the housing fixture 35 formed into the floor panel 36 and sidewalls 34 of the wash basin 30.

Figure 6:
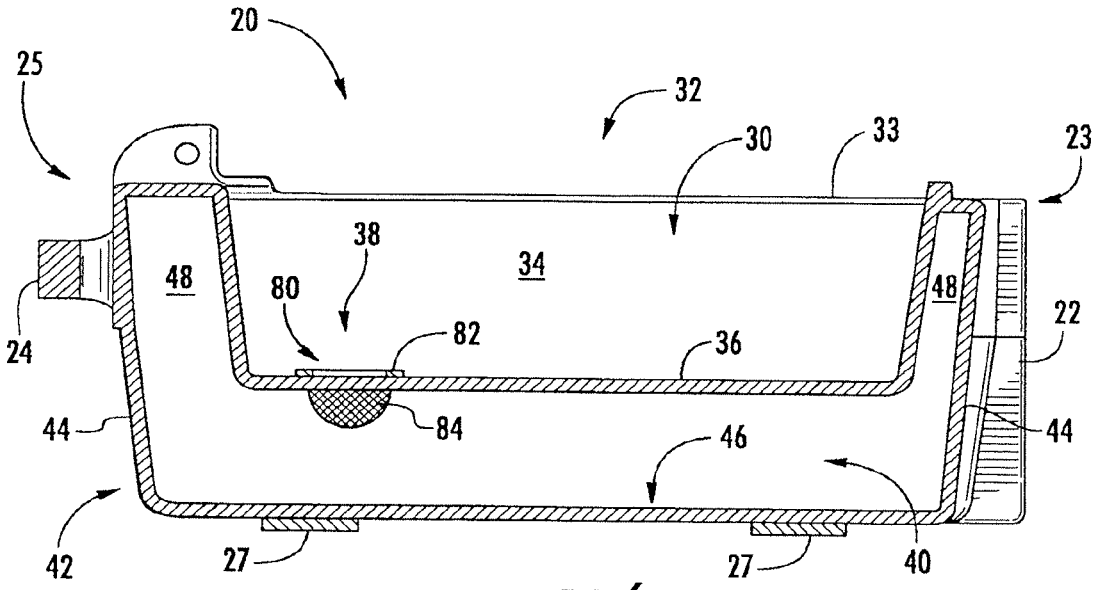
FIG. 6 is a cross-sectional side view of the washer body as viewed from section line A-A in FIG. 5.

FIG. 6 is a cross-sectional side view of the washer body 20 as viewed from section line A-A in FIG. 5, and illustrates the internal reservoir 40 located beneath the floor panel 36 of the wash basin 30 and above the bottom panel 46 of the washer body 20. The floor panel 36 is spaced a sufficient distance above the bottom panel 46 to provide for a minimal overall volume of cleaning fluid to be contained within the internal reservoir 40 without completely filling the internal reservoir 40 to the level of the drain aperture 38. In one embodiment this minimal overall volume can be about 3 liters. In other embodiments this minimal overall volume can be about 4 liters, can be about 5 liters, or can be more than 5 liters. In one aspect, the minimal overall volume may be the amount of cleaning fluid necessary to maintain a nominal amount of cleaning fluid within the internal reservoir when the pumping unit is being operated, so that the pump suction inlet will remain submerged and the pumping unit will not run dry. Alternatively, the minimal overall volume may be the amount of cleaning fluid necessary to sustain a sufficient colony of microorganisms to maintain a bio-remediating or bio-degrading reaction within the cleaning fluid which naturally removes the oil and grease from the cleaning fluid, so that the volume of cleaning fluid can be repeatedly re-used without replacement and for an extended period of time.

The drain aperture 38 can be provided with a strainer 80. The strainer 80 can include a rigid rim 82 supporting a wire mesh 84 or similar screen that can extend downward into the interior reservoir 40. The wire mesh 84 can form apertures that are small enough to prevent the passage of particulate material which may damage the pumping system 60. In some aspects the strainer 80 can be easily removable from the drain aperture 38 for cleaning, and may be replaced with a substantially solid plug or seal (not shown) which help prevent the splashing or spilling of cleaning fluid during movement of the portable parts washer. Nevertheless, as discussed in more detail below, the internal reservoir 40 can be configured so that drain aperture 38 does not require a plug or seal in order to maintain the cleaning fluid within the internal reservoir during transport, and thus the plug or seal may function as a precautionary back-up sealing device.

Figure 7:
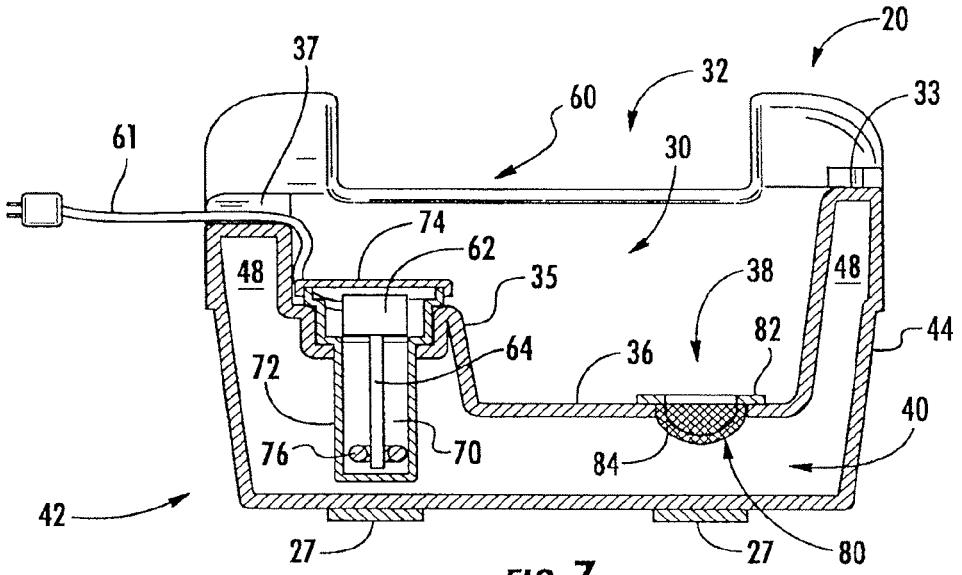
FIG. 7 is a cross-sectional end view of the washer body as viewed from section line B-B in FIG. 5.

One or more of the inner sidewalls 34 of the wash basin 30 can be spaced far enough from its adjacent outer sidewall 44 of the washer body 20 so as to form a gap portion 48 of the internal reservoir 40 that extends upwardly between wash basin 30 and the outer sidewalls 44 on at least one side of the washer body 20. As can be seen in FIG. 6, gap portions 48 can be formed along both the front end 25 and back end 23 of the washer body 20. Gap portions 48 can also be formed along both sides of the washer body 20, as shown in FIG. 7. In this configuration, the various gap portions 48 can combine to form a perimeter gap portion of the internal reservoir 40 that surrounds the wash basin 30 and which can, depending upon the widths of the various gap portions 48, significantly expand the total volume of the internal reservoir 40. In one aspect, the perimeter gap can provide for fifty percent or more of the total volume of the internal reservoir 40 (or otherwise, so as to hold 100% of the fluid), so that in the event the portable parts washer were to be completely tipped over and inverted, that the cleaning fluid would remain substantially contained within the perimeter gap portion of the internal reservoir and generally would not rise to the level of the inverted drain aperture.

One embodiment of a pumping unit 60 is also shown in more detail in FIG. 7, and can include a pump 62 with an inlet connected to a suction tube 64 which extends downward into a pump chamber 70 defined by a pump housing 72. The pump chamber 70 is in fluid communication with the internal reservoir 40 through one or more apertures 76 formed though the walls of the pump housing 72, so that the cleaning fluid can flow freely into the pump chamber. As illustrated, the pump housing 72 can be a separate structure that is removable from the washer body 20, and which may be received and supported within the housing fixture 35 formed into the sidewalls 34 and flow panel 36 of the wash basin 30, as described above. In other aspects the pump housing 72 can be formed integral with the washer body 20, or in any suitable location for establishing fluid communication with the internal reservoir 40. In addition, the pump 62 is not limited to any particular type, and be selected from a variety of pumping devices known to one of skill in the art, including positive displacement pumps, centrifugal pumps, screw pumps, and the like.

Figure 8A:
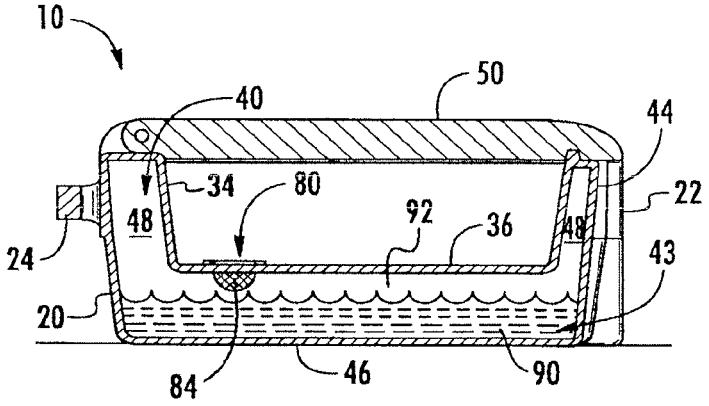
FIGS. 8A and 8B are cross-sectional side views of the closed parts washer of FIGS. 1 and 2 with cleaning fluid in a horizontal orientation and in a vertical, upright orientation, respectively.
Figure 8B:
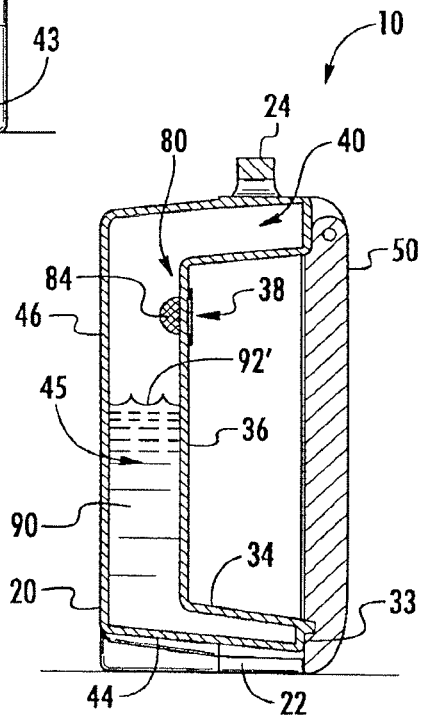

FIGS. 8A and 8B are cross-sectional side views of the closed parts washer 10 of FIG. 1 in a horizontal orientation and in a vertical, upright orientation, respectively, and filled with at least the minimal total amount of cleaning fluid 90 described above. As shown in FIG. 8A, the level of the surface 92 of the pool of cleaning fluid 90 contained in the interior reservoir 40 may reach near to the bottom of the mesh screen 84 of the strainer 80, and can define an in-use volume 43 of the internal reservoir 40. With the parts washer 10 in the horizontal orientation, the "in-use" volume 43 can generally be the same whether the lid 50 is closed or whether the lid 50 is open and the pumping unit 60 is in operation, although the level of the surface 92 may drop slightly as the withdrawn portion of cleaning fluid 90 is sprayed over the parts in the wash basin 30.

When the parts washer 10 is rotated to the vertical and upright orientation of FIG. 8B, the cleaning fluid 90 moves down to fill the gap portions 48 between the inner sidewalls 34 of the wash basin 30 and the outer sidewall 44 of the washer body 20. As shown, the gap portions 48 can be sized so that the relocated surface 92' of the pool of cleaning fluid 90 contained in the interior reservoir 40 can remain below the drain aperture 30 and strainer 80, and can thus define a "storage" volume 45 of the internal reservoir 40. Generally, the in-use volume 43 shown in FIG. 8A and the storage volume 45 shown in FIG. 8B have a common portion wherein the two volumes overlap.

In general, the outer sidewalls 44, bottom panel 46, inner sidewalls 34, floor panel 36 and top edges 33 of the washer body 20 can be formed from a solid and corrosion resistant material that forms a substantially continuous fluid-tight barrier surrounding both the in-use volume 43 and the storage volume 45 of the internal reservoir. For example, in some embodiments the cleaning fluid 90 can comprise a surfactant or similar active chemical mixture that naturally breaks down the oil and grease which is washed from the mechanical parts being cleaned in the wash basin 30 (and also supports living microorganisms). However, the same mixtures which can break down grease and oil may also break down oil-based plastic and rubber-based seals and fittings. Thus, in some aspects it can be advantageous for the fluid-tight barrier to be formed without sealed openings or fittings, and instead from continuous panels and walls of high density polyethylene (HDPE) or similar material which has been pressure molded or injected into the necessary shapes and structures. This can ensure that the cleaning fluid will remain contained and secured within the interior reservoir of the parts washer 40 for extended periods of time, and without the possibility of leaks developing from seals which can degrade or fittings which can loosen. According to one embodiment, the washer body 20 is configured such that no opening in the washer body is below the surface 92, 92' of the cleaning fluid 90, when the washer 10 is in either the horizontal orientation or the vertical and upright orientation.

In one embodiment of the present disclosure the washer body 20 can be provided with a plugged reservoir drain aperture 49 (FIG. 2) which is not located in either of the in-use volume 43 or storage volume 45 of the internal reservoir 40, but is instead located at a remote location proximate a top edge and the handle 24 which will not normally contact the cleaning fluid 90. Thus, the reservoir drain aperture 49 will only come into contact with the cleaning fluid 90 when the washer body 20 is completely inverted, or tilted so as to direct fluid specifically to the drain aperture 49, such as during a periodic maintenance cycle when the cleaning fluid 90 is emptied from the portable parts washer 10, typically into an appropriate disposal system.

The use of microorganisms in the surfactant can be advantageous in that the cleaning fluid can remain useful at ambient room temperature. According to some embodiments, additional heating of the fluid's not required. As such, the parts washer 10 of the present disclosure generally does not require an additional fluid heater located within the interior reservoir for heating the cleaning fluid 90 prior to use. However, if so desired the parts washer 10 can be provided with a fluid heater (not shown) which can be submerged within the in-use volume 43 of the cleaning fluid 90, such as in a location above the bottom panel 46 of the washer body 10. The fluid heater may be an electrical resistant heater that is in electrical communication with the same power cord 61 as the pumping unit 60 (FIG. 3-4), so that only one connection need be established to power all of the electrical systems located within the portable parts washer 10.

Figure 9:
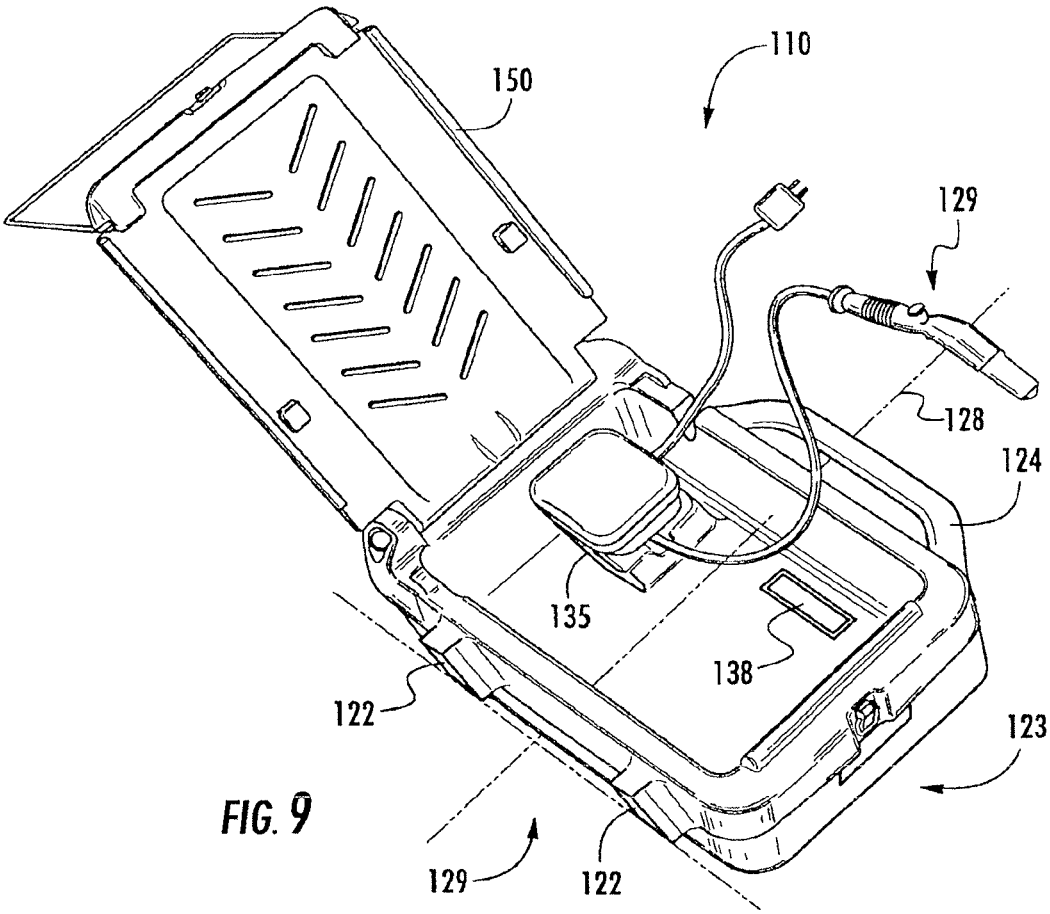
FIG. 9 is a perspective top view of the portable parts washer an open and horizontal, in-use configuration, in accordance with another representative embodiment of the disclosure.
Figure 10:
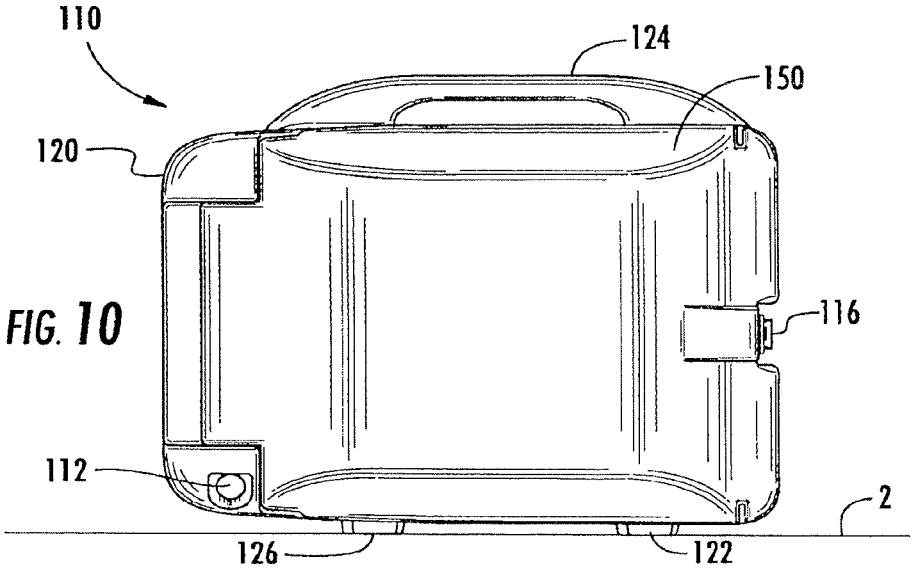
FIG. 10 is a perspective side view of the portable parts washer of FIG. 9 in the open and horizontal, in-use configuration.

Another representative embodiment of the portable parts washer 110 is shown in FIGS. 9 and 10. In this configuration, the feet 122 of the washer body 120 project outwardly from a lateral sidewall 129 of the washer body 120 instead of from the back end 123, and the handle 124 projects outwardly from the lateral sidewall 129 on the opposite side of washer body 120. Thus, the pivot axis 126 is now parallel with the longitudinal axis of the parts washer 110 and the lifting axis 128 is perpendicular to the longitudinal axis, extending through the center of the washer body from between the feet 122 toward the handle 124. In a similar fashion, the pump housing fixture 135 and the drain aperture 138 have been relocated within the wash basin 130 so that the cleaning fluid does not escape when the parts washer 110 is rotated about the pivot axis 126 to a vertical and upright position supported on the feet 122 on a base surface 2 (FIG. 10).

The invention has been described in terms of preferred embodiments and methodologies considered by the inventors to represent the best mode of carrying out the invention. A wide variety of additions, deletions, and modification might well be made to the illustrated embodiments by skilled artisans within the scope of the invention. For example, the lid may be rotatably attached to the top edge of a lateral sidewall of the washer body instead of to one of the front or back ends. In addition, the parts washer may be constructed with a different aspect ratio that is more or less elongate than the parts washer described herein. These and other revisions might be made by those of skill in the art without departing from the spirit and scope of the invention, which is constrained only by the following claims.

We claim:

1. A portable parts washer for in-situ cleaning of mechanical parts, the parts washer comprising:

a washer body having an upper portion and a lower portion and being rotatable between an in-use horizontal orientation and a totable vertical orientation, the washer body having a wash basin formed into the upper portion and having inner sidewalls, a floor panel, and at least one drain aperture defined in the floor panel, with top edges of the upper portion defining a wash basin opening, and an internal reservoir formed in the lower portion and having a bottom panel spaced from the floor panel and outer sidewalls extending from the bottom panel to the top edges of the upper portion of the wash basin, the internal reservoir being configured to received fluid from the wash basin through the at least one drain aperture when the washer body is in the horizontal orientation; and a cleaning fluid having microorganisms that degrade or remove oil or grease mixed with the cleaning fluid stored within the internal reservoir and maintained within the internal reservoir when the washer body is rotated from the horizontal orientation to the vertical orientation.

2. The portable parts washer of claim 1, further comprising a pumping unit configured to withdraw the cleaning fluid from the internal reservoir and to discharge the cleaning fluid into the wash basin onto a mechanical part placed within the wash basin.

3. The portable parts washer according to claim 2, wherein the pumping unit includes a pump connectable to a power source and having an inlet in fluid communication with the intimal reservoir and an outlet, a flexible tube in fluid communication with the outlet, a nozzle in fluid communication with the flexible tube, and a switch configured to activate the pump.

4. The portable parts washer according to claim 3, wherein the outer sidewalls are spaced from the inner sidewalls to form a perimeter gap portion of the intimal reservoir that extends above the at least one drain aperture when the washer body is in the horizontal orientation.

5. The portable parts washer according to claim 4, wherein the perimeter gap portion comprises at least 50% of a total volume of the intimal reservoir.

6. The portable parts washer according to claim 1 further comprising a lid rotatably coupled to the body proximate a top edge and configured to cover a wash body basin opening when the lid is in a closed position.

7. The portable parts washer according to claim 6 further comprising a handle formed into one of the outer sidewalls and adapted to suspend the washer body in a vertical orientation.

8. A parts washer for in-situ cleaning of mechanical parts, the parts washer comprising:

a washer body having an upper portion and a lower portion and being rotatable between an in-use horizontal orientation and a totable vertical orientation, the washer body including:

a wash basin formed within the upper portion and having inner sidewalls, a floor panel and at least one drain aperture defined in the floor panel;

a cleaning fluid having microorganisms that degrade or remove oil or grease mixed with the cleaning fluid; and an internal reservoir formed within the lower portion and having a bottom panel spaced from the floor panel, outer sidewalls extending from the bottom panel to top edges of the upper portion of the wash basin, the reservoir configured to receive the cleaning fluid from the wash basin through the at least one drain aperture when the washer body is in the horizontal orientation; and the outer sidewalls being spaced from the inner sidewalls to form a perimeter gap portion of the internal reservoir that extends above the at least one drain aperture when the washer body is in the horizontal orientation, wherein the perimeter gap portion comprises at least 50% of a total volume of the internal reservoir.

9. The portable parts washer as in claim 8, wherein the cleaning fluid is stored within the internal reservoir and maintained within the internal reservoir when the washer body is rotated from the horizontal orientation to the vertical orientation.

10. A recirculating parts washer for in situ cleaning of mechanical parts, the parts washer comprising:

a washer body having an upper portion and a lower portion and rotatable between an in-use horizontal orientation and a totable vertical orientation, the washer body having a wash basin formed within the upper portion and having inner sidewalls, a floor panel and at least one drain aperture defined in the floor panel, a cleaning fluid having microorganisms that degrade or remove oil or grease mixed; and an internal reservoir formed within the lower portion and having outer sidewalls and a bottom panel spaced from the floor panel, and configured to receive cleaning fluid from the wash basin through the at least one drain aperture when the washer body is in the horizontal orientation, the outer sidewalls extending from the bottom panel to top edges of the upper portion of the wash basin and spaced from the inner sidewalls to form a perimeter gap portion of the internal reservoir that extends above the at least one drain aperture when the washer body is in the horizontal orientation and the at least one drain aperture being offset from a center of the washer body, the cleaning fluid maintained within the internal reservoir when the washer body is rotated from the horizontal orientation to the vertical orientation; and a pumping unit configured to withdraw the cleaning fluid from the internal reservoir and to discharge the cleaning fluid into the wash basin.

11. The portable parts washer as in claim 10 further comprising a handle formed into one of the outer sidewalls and adapted to suspend the washer body in the vertical orientation.

12. The portable parts washer as in claim 10 further comprising a lid rotatably coupled to washer body proximate a top edge of the upper portion and configured to cover a wash basin opening when the lid is in a closed position.

13. The portable parts washer as in claims 10, wherein the pumping unit includes a pump connectable to a power source and having an inlet in fluid communication with the intimal reservoir and an outlet, a flexible tube in fluid communication with the outlet, a nozzle in fluid communication with the flexible tube, and a switch configured to activate the pump.

14. The portable parts washer as in claims 10, wherein the outer sidewalls are spaced from the inner sidewalls to form a perimeter gap portion of the internal reservoir that extends above the at least one drain aperture when the washer body is in the horizontal orientation.

15. The portable parts washer as in claim 14, wherein the perimeter gap portion comprises at least 50% of a total volume of the internal reservoir.

* * * * *